US005858128A

United States Patent [19]

Miyata et al.

[11] Patent Number: 5,858,128

[45] **Date of Patent: *Jan. 12, 1999**

[54] HIGH CHROMIUM MARTENSITIC STEEL PIPE HAVING EXCELLENT PITTING RESISTANCE AND METHOD OF MANUFACTURING

[75] Inventors: Yukio Miyata; Mitsuo Kimura; Tomoya Koseki; Takaaki Toyooka; Fumio Murase, all of Aichi, Japan

[73] Assignee: Kawasaki Steel Corporation, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 634,860

[22] Filed: Apr. 19, 1996

[30] Foreign Application Priority Data

Apr. 21, 1995 [JP] Japan ..... 7-097063
Feb. 23, 1996 [JP] Japan ..... 8-036247

[51] Int. Cl.[6] ..... C22C 38/18

[52] U.S. Cl. ..... 148/325; 148/326; 420/60

[58] Field of Search ..... 148/590, 325, 148/326; 420/60

[56] References Cited

FOREIGN PATENT DOCUMENTS

| | | |
|---|---|---|
| 57-13152 | 1/1982 | Japan . |
| 57-5849 | 1/1982 | Japan . |
| 4-99154 | 3/1992 | Japan . |
| 4-99155 | 3/1992 | Japan . |
| 05-148592 | 6/1993 | Japan . |
| 5-140645 | 6/1993 | Japan . |
| 5-148592 | 6/1993 | Japan . |
| 6-88130 | 3/1994 | Japan . |
| 6-100935 | 4/1994 | Japan . |
| 06-128694 | 5/1994 | Japan . |
| 6-136490 | 5/1994 | Japan . |
| 2 027 745 | 2/1980 | United Kingdom . |
| WO 95/34690 | 12/1995 | WIPO . |

*Primary Examiner*—Sikyin Ip
*Attorney, Agent, or Firm*—Austin R. Miller

[57] ABSTRACT

A high-Cr martensitic steel pipe having excellent pitting resistance and method for manufacturing the same, which involves forming a pipe of steel including C: about 0.03 wt % or less, Si: about 0.5 wt % or less, Mn: about 0.5–3.0 wt %, Cr: about 10.0–14.0 wt %, Ni: about 0.2–2.0 wt %, Cu: about 0.2–1.0 wt % and N: about 0.03 wt % or less with the balance being Fe and incidental impurities, and having a value X shown as defined in the following formula (1) of about 12.2 or more. The pipe is quenched after austenitizing it at a temperature substantially equal to an $Ac_3$ point or higher, and the pipe is tempered in a temperature range from about 550° C. or higher to a temperature lower than an $Ac_1$ point.

$$\text{value } X = (\text{Cr } \%) + 3(\text{Cu } \%) - 3(\text{C } \%) \quad (1)$$

The high-Cr martensitic steel pipe made by this method exhibits excellent pitting resistance and general corrosion resistance even in an environment containing a carbonic acid gas, and further exhibits excellent weldability and toughness in the heat-affected zones.

4 Claims, No Drawings

HIGH CHROMIUM MARTENSITIC STEEL PIPE HAVING EXCELLENT PITTING RESISTANCE AND METHOD OF MANUFACTURING

BACKGROUND OF THE INVENTION

1. Field of the Invention

The present invention relates to a martensitic stainless steel pipe having excellent corrosion resistance and a method for manufacturing the same. The invention may be used in petroleum and natural gas pipelines.

2. Description of the Related Art

Almost all of the petroleum and natural gas in the world which can be easily extracted has been recovered. Therefore, more and more development is taking place in severe environments, particularly in wells deep underground, frigid locations and offshore sites.

Significant quantities of carbonic acid gas are often contained in petroleum and natural gas recovered from wells located in these severe environments, thereby causing great corrosion of carbon steel or low alloy steels. To cope with this problem, an inhibitor is conventionally added to such steels as a corrosion prevention means.

However, inhibitors not only increase the cost of the steels, they are not effective at high temperatures. Steels which are corrosion resistant without inhibitors, such as martensitic stainless steel containing 13% Cr, are now widely used in place of steels containing inhibitors.

API Standards require that a line pipe be composed of 12% Cr martensitic stainless steel containing a reduced amount of C. However, this steel is almost never employed as line pipe because preheating and post welding heat treatment are required for girth welding, which tremendously increases costs. Further, toughness in the welded portions is poor. Consequently, dual-phase stainless steel having an increased amount of Cr as well as Ni and Mo is often used as corrosion resistant line pipe because it possesses excellent weldability and corrosion resistance. However, the dual-phase stainless steel is expensive and often exceeds the requirements dictated by conditions in some wells.

A method of manufacturing a martensitic stainless steel line pipe is disclosed in, for example, Japanese Patent Application Laid-Open No. 4-99128 as a means for overcoming the above problem. Disclosed therein is a method of manufacturing a line pipe of 13% Cr stainless steel which comprises 1.2–4.5% Cu and reduced contents of C and N. After the 13% Cr stainless steel is formed into a pipe, the pipe is cooled at a quenching cooling rate higher than that effected by water. As a result, the stainless steel pipe exhibits excellent corrosion resistance even in a corrosive environment containing a carbonic acid gas, has low hardness in a heat-affected zone and avoids quench cracking. However, this method still fails to produce sufficient toughness in the heat-affected zone.

An object of the present invention is to provide a martensitic stainless steel pipe having high general corrosion resistance, high pitting resistance, excellent weld cracking resistance and toughness in a heat-affected zone, including a method of manufacturing this martensitic stainless steel pipe.

SUMMARY OF THE INVENTION

We have discovered a high-Cr martensitic stainless steel for line pipe having excellent corrosion resistance and weldability and, in particular, heat-affected zone toughness, all required in a carbonic acid gas environment, and a method for manufacturing this remarkable high-Cr martensitic stainless steel. The high-Cr martensitic stainless steel of the invention is produced by applying a proper heat treatment to Cr steel in which C and N contents are each reduced to about 0.03 wt % or less and Cu content is controlled to about 0.2–0.7 wt %.

That is, the present invention provides a method of manufacturing a high-Cr martensitic steel pipe which exhibits excellent pitting resistance, comprising the steps of making a steel pipe from a steel comprising C: about 0.03 wt % or less, Si: about 0.5 wt % or less, Mn: about 0.5–3.0 wt %, Cr: about 10.0–14.0 wt %, Ni: about 0.2–2.0 wt %, Cu: about 0.2–0.7 wt % and N: about 0.03 wt % or less, with the balance being Fe and incidental impurities, and having a value X as defined in the following formula of about 12.2 or more:

$$\text{value } X=(\text{Cr }\%)+3(\text{Cu }\%)-3(\text{C }\%) \quad (1)$$

quenching the pipe after austenitizing it at a temperature substantially equal to the $Ac_3$ point or higher; and tempering the pipe in a temperature range from about 550° C. to lower than the $Ac_1$ point.

Further, the invention provides a method of manufacturing a high-Cr martensitic steel pipe having excellent pitting resistance, wherein after the above-described steel is formed into a steel pipe, the steel pipe is quenched after it is austenitized at a temperature substantially equal to the $Ac_3$ point or higher, followed by air cooling the steel pipe.

The present invention further provides a method of manufacturing a high-Cr martensitic steel pipe having excellent pitting resistance, wherein after the above-described steel is formed into a steel pipe, the steel pipe is quenched after it is austenitized at a temperature substantially equal to the $Ac_3$ point or higher, thereafter the steel pipe is heat treated by maintaining the steel pipe in a temperature range from the $Ac_1$ point to the $Ac_1$ point+about 50° C. for about 10–60 minutes. The steel pipe is subsequently cooled and tempered at a temperature lower than the $Ac_1$ point.

Further, according to the present invention, there is provided a high-Cr martensitic steel pipe having excellent pitting resistance, formed from a steel comprising C: about 0.03 wt % or less, Si: about 0.5 wt % or less, Mn: about 0.5–3.0 wt %, Cr: about 10.0–14.0 wt %, Ni: about 0.2–2.0 wt %, Cu: about 0.2–0.7 wt % and N: about 0.03 wt %, with the balance being Fe and incidental impurities, and having a value X as defined in the following formula of about 12.2 or higher:

$$\text{value } X=(\text{Cr }\%)+3(\text{Cu }\%)-3(\text{C }\%) \quad (1).$$

Further, the invention provides a high-Cr martensitic steel pipe having excellent pitting resistance, made from a steel which, in addition to the above-described components, further comprises at least one element selected from Ti, V, Zr, Nb and Ta in a total amount of about 0.3 wt % or less, and having a value Y as defined in the following formula (2) of about 12.2 or more:

$$Y\text{value}=(\text{Cr }\%)+3(\text{cu }\%)-3(\text{c }\%)+(\text{Ti }\%)+(\text{V }\%)+(\text{Zr }\%)+(\text{Nb }\%)+(\text{Ta }\%) \quad (2).$$

Other embodiments and equivalents of the present invention will become apparent from the following detailed description.

DETAILED DESCRIPTION OF THE INVENTION

The components and associated content limits of the martensitic stainless steel of the present invention will now be described.

C: about 0.03 wt % or less

C is preferably reduced as much as possible in order to reduce the hardness of the heat-affected zone, enhance toughness and weld cracking resistance, and to increase the corrosion resistance and pitting resistance in a carbonic acid gas environment. C content must be controlled to about 0.03 wt % or less to permit welding of the stainless steel without preheating, and is preferably controlled to about 0.02 wt % or less.

Si: about 0.5 wt % or less

Si is contained in the present invention as a deoxidizing element. However, since Si promotes the formation of ferrite, excessive amounts of Si increase ferrite content in the steel and deteriorate the toughness of the steel and the heat-affected zone thereof. In addition, the presence of ferrite can render seamless steel pipe production difficult. Thus, Si content is controlled to about 0.5 wt % or less and preferably about 0.3 wt % or less.

Mn: about 0.5–3.0 wt %

Mn is required in the invention to promote deoxidation and increase strength. Further, since Mn is an austenite former element, it acts to suppress the formation of ferrite and improve the toughness of the steel and the heat-affected zone thereof. Mn provides these benefits when at least about 0.5 wt % is present. The benefits provided by Mn do not further accrue when contents exceed about 3.0 wt %, thus Mn content is controlled to about 0.5–3.0 wt % and preferably about 0.8–2.7 wt %.

Cr: about 10.0–14.0 wt %

Cr is required in the invention to produce a martensitic microstructure and promote corrosion resistance to carbonic acid gas. About 10.0 wt % or more Cr must be present to obtain these benefits. On the other hand, if Cr content exceeds about 14.0 wt %, the formation of ferrite is promoted. Consequently, a large amount of an austenite-promoting element must be added to stably obtain the martensitic structure, thereby increasing costs. Thus, Cr content is controlled to about 10.0–14.0 wt %.

Ni: about 0.2–2.0 wt %

Ni serves as an austenite-promoting element in the present invention which compensates for the reduction of C and N. Ni also improves the corrosion resistance and toughness of a steel in a carbonic acid gas environment. To realize these benefits, Ni content must be about 0.2 wt % or more. However, if the Ni content exceeds about 2.0 wt %, the $Ac_1$ point is lowered such that annealing must be effected for an extended time, thereby inflating production costs. Thus, Ni content is controlled to about 0.2–2.0 wt % and preferably about 0.5–1.7 wt %.

Cu: about 0.2–0.7 wt %

Cu compensates for the reduction of C and N by acting as an austenite-promoting element together with Ni and Mn. Cu also improves toughness in the heat-affected zone and promotes corrosion resistance to carbonic acid gas. Cu content must be about 0.2 wt % or more to realize these benefits. However, Cu contents exceeding about 1.0 wt % cause partial precipitation of Cu (i.e., some Cu is not dissolved in solid) and adversely affects the toughness of the steel and the heat-affected zone. Thus, Cu content ranges from about 0.2–0.7 wt %.

N: about 0.03 wt % or less

N content is preferably minimized like that of C to reduce hardness and enhance the toughness of the heat-affected zone, as well as to promote weld cracking resistance. When N content exceeds about 0.03%, weld cracking occurs and heat-affected zone toughness deteriorates. Therefore, N content is controlled to about 0.03% or less and preferably about 0.02% or less. Total content Ti, V, Zr, Nb, Ta: about 0.3% or less Ti, V, Zr, Nb, Ta each have a strong affinity for C and a strong carbide-forming tendency. Cr carbide is replaced with Ti, V, Zr, Nb and/or Ta carbide by adding at least one of Ti, V, Zr, Nb, Ta. Through these additions, Cr carbide content is reduced, thereby effectively increasing the amount of Cr available to enhance corrosion resistance and pitting resistance of the steel.

Although Ti, V, Zr, Nb, Ta improve the toughness of the steel and the heat-affected zone, when their total quantity exceeds about 0.3%, weld cracking sensitivity increases and toughness deteriorates. Thus, the upper total content limit is controlled to about 0.3%.

It is preferable that the Ti content be about 0.01–0.2%, V content be about 0.01–0.1%, zr content be about 0.01–0.1%, Nb content be about 0.01–0.1% and Ta content be about 0.01–0.1%. When added in composite, their total content is preferably about 0.03–0.2%.

Although the other elements may be incidentally contained in the invention, their content is preferably reduced as much as possible. For example, although the maximum contents of P and S are about 0.03 wt % and about 0.01 wt %, respectively, it is preferable to reduce these amounts as much as possible. A content of 0 is permitted up to about 0.01 wt %.

value X: about 12.2 or more $$\text{value } X=(\text{Cr }\%)+3(\text{Cu }\%)-3(\text{C }\%) \quad (1)$$

$$Y\text{value}=(\text{Cr }\%)+3(\text{cu }\%)-3(\text{c }\%)+(\text{Ti }\%)+(\text{V }\%)+(\text{Zr }\%)+(\text{Nb }\%)+(\text{Ta }\%) \quad (2)$$

The value X is an index for evaluating pitting resistance in an environment containing a carbonic acid gas. We discovered that when the index is about 12.2 or more, no pitting occurs even when a steel is exposed to a 20% NaCl solution in which carbonic acid gas of 3.0 MPa is saturated. Since pitting occurs when the value X is less than about 12.2, the lower limit of the value X is about 12.2. When the value X is too high, martensitic structure is difficult to obtain. Therefore, the value X preferably ranges from about 12.2–14.2.

Stainless steel having the above composition is prepared in a converter or an electric furnace and is solidified by continuous casting or other known casting methods. Molten steel may be refined in a ladle, degassed in vacuum, or subjected to other processings when necessary.

A steel having a composition in accordance with the invention is formed into a pipe through known seamless steel pipe making methods such as the plug mill method, the mandrel mill method or the like, or through known welded steel pipe manufacturing methods like those used in the production of electric resistance welding steel pipe, UOE steel pipe, and spiral steel pipe, for example. Thereafter, the steel pipe is subjected to a heat treatment(s), wherein the steel pipe is austenitized at a temperature substantially equal to the $Ac_3$ point or higher and then quenched.

The austenitization is effected at a temperature substantially equal to the $Ac_3$ point or higher to make the steel structure uniform and provide the steel pipe with predetermined characteristics. However, when the austenitization is performed at an excessively high temperature, particles are roughened, toughness deteriorates and energy costs increase. Thus, the temperature for the austenitization is controlled to substantially the $Ac_3$ point or higher, and preferably in the temperature range of the $Ac_3$ point to the $Ac_3$ point+about 100° C. Importantly, a steel having a micro-structure according to the present invention can possess a single phase martensitic microstructure by being air-cooled after austenitization.

The above heat treatment performed after quenching is an important to achieving the advantageous characteristics of the present invention. The following three types of methods (1), (2), (3) can be applied in accordance with the invention.

(1) Tempering effected at about 550° C. or higher to a temperature lower than the $Ac_1$ point Since the steel pipe is made to a uniformly tempered martensitic microstructure by being tempered in a temperature range from about 550° C. to lower than the $Ac_1$ point, excellent toughness can be obtained. When the tempering temperature is lower than about 550° C., tempering is insufficiently performed and adequate toughness cannot be obtained.

Importantly, the steel pipe is preferably held for about 10 minutes or longer in the above temperature range during the tempering process, and the steel pipe may be air-cooled or water-cooled after it is tempered in accordance with the invention.

(2) Heat treatment performed in a temperature range from the $Ac_1$ point to the $Ac_1$ point+about 50° C. (heat treatment in a dual-phase region)

A steel pipe in accordance with the invention is made to a fine dual-phase microstructure composed of martensitic and austenite by being subjected to a heat treatment at the $Ac_1$ point or higher and made to a fine martensitic microstructure by being cooled thereafter. Although un-tempered martensitic which is not tempered is mixed in the micro structure, the fine structure increases toughness. However, when a steel pipe is subjected to a heat treatment at a temperature exceeding the $Ac_1$ point+about 50° C., grains are roughened and toughness deteriorates.

The steel pipe is preferably held between about ten minutes to 60 minutes in this temperature range, and thereafter may be air-cooled.

(3) Heat treatment performed in a temperature range from the $Ac_1$ point to the $Ac_1$ point+about 50° C., and tempering performed thereafter at a temperature substantially equal to the $Ac_1$ point or lower When steel having a micro structure resulting from a heat treatment in accordance with the above item (2) is thereafter tempered, a fine tempered martensitic micro-structure can be obtained. Thus a steel pipe having higher toughness results.

The holding time in the respective temperature ranges in the item (3) is the same as those described for the above items (1) and (2), and the steel pipe may be air-cooled after it is held for the periods described above.

Which heat treatment(s) are used may be determined by considering the characteristics required and the manufacturing costs.

The invention will now be described through illustrative examples. The examples are not intended to limit the scope of the appended claims.

EXAMPLE 1

Steels having compositions as shown in Table 1 were prepared and formed into seamless steel pipes each having a wall thickness of 0.5" (12.7 mm). Subsequently, the steel pipes were subjected to a heat treatment at temperatures also shown in Tables 1-(1) (Examples of the Invention) and 1-(2) (Comparative Examples). Q in Table 1 represents quenching temperatures for austenitization, Td represents dual-phase region heat treatment temperatures and T represents tempering temperatures equal to or lower than the $Ac_1$ point. The holding time for these heat treatments was thirty minutes, and cooling was effected by air in all cases. Joints were formed through girth welding utilizing a TIG welding method (neither preheating nor post-heat was effected).

Specimens were sampled from the thusly obtained welded joints and a Charpy test was performed on the heat-affected zones. The heat-affected zone of the specimens were exposed to carbonic acid gas to evaluate corrosion resistance.

The Charpy test involved sampling full-size specimens sampled from the heat-affected zones and measuring absorbed energies at 0° C. The corrosion test involved preparing specimens of 3.0 mm×25 mm×50 mm to include mother material and welded portions, dipping the specimens into a 20% NaCl solution in which a carbonic acid gas of 3.0 MPa was saturated, and holding the specimens in that corrosive environment for seven days at 80° C. using an autoclave. The corrosion rate of 0.1 mm/year or less of mother material, including welded portions, immersed in a corrosion test liquid of 20% NaCl solution in which a carbonic acid gas of 3.0 MPa was saturated at 80° C. were evaluated by comparing their evaluated weight loss rate during the test. The results of the test are shown in Tables 1-(1) and 1-(2).

As seen in Table 1-(1) the steel pipes made in accordance with the present invention have absorbed energy for heat-affected welded portion of $vEo \leqq 170J$ at 0° C. The examples of the invention exhibit excellent toughness. In addition, the corrosion rates are 0.1 mm/y or slower in the examples of the invention, which is well within tolerances expected of a corrosion resistant material in practical use. Moreover, no selective corrosion affected the welded portions, and the steel pipes in accordance with the invention demonstrated excellent corrosion resistance to the carbonic acid gas. Since neither preheating nor postheating was necessary to perform the welding, it is apparent that the steel pipes in accordance with the invention also have excellent weldability.

Test results for the Comparative Examples were inferior to those of Examples of the Invention, as seen in Table 1-(2).

TABLE 1

| | Chemical Composition (wt %) | | | | | | | $Ac_1$ Point | $Ac_3$ Point | Heat Treatment Temperature (°C.) | | | (*1) | (*2) |
|---|---|---|---|---|---|---|---|---|---|---|---|---|---|---|
| No. | C | Si | Mn | Cr | Ni | Cu | N | (°C.) | (°C.) | Q | $T_d$ | T | $_vE_0$ (J) | (mm/y) |
| Examples of the Invention | | | | | | | | | | | | | | |
| 1 | 0.010 | 0.21 | 1.49 | 12.1 | 0.25 | 0.25 | 0.009 | 750 | 860 | 1000 | — | 700 | 180 | 0.072 |
| 2 | 0.025 | 0.20 | 1.52 | 12.0 | 0.25 | 0.24 | 0.011 | 730 | 840 | 1000 | — | 700 | 170 | 0.084 |
| 3 | 0.011 | 0.20 | 1.51 | 11.9 | 1.02 | 0.24 | 0.011 | 700 | 810 | 950 | — | 650 | 220 | 0.054 |
| 4 | 0.012 | 0.19 | 1.48 | 12.0 | 0.24 | 0.51 | 0.012 | 740 | 850 | 1600 | — | 700 | 195 | 0.082 |
| 5 | 0.011 | 0.18 | 1.47 | 11.9 | 1.03 | 0.49 | 0.011 | 700 | 810 | 950 | — | 650 | 202 | 0.056 |
| 6 | 0.011 | 0.18 | 1.47 | 11.9 | 1.03 | 0.49 | 0.011 | 700 | 810 | 950 | 715 | — | 221 | 0.061 |

TABLE 1-continued

| | Chemical Composition (wt %) | | | | | | | $Ac_1$ Point | $Ac_3$ Point | Heat Treatment Temperature (°C.) | | | (*1) | (*2) |
|---|---|---|---|---|---|---|---|---|---|---|---|---|---|---|
| No. | C | Si | Mn | Cr | Ni | Cu | N | (°C.) | (°C.) | Q | $T_d$ | T | $_vE_0$ (J) | (mm/y) |
| 7 | 0.011 | 0.18 | 1.47 | 11.9 | 1.03 | 0.49 | 0.011 | 700 | 810 | 950 | 715 | 650 | 254 | 0.055 |
| 8 | 0.012 | 0.21 | 1.51 | 11.1 | 0.25 | 0.26 | 0.010 | 750 | 840 | 950 | — | 700 | 195 | 0.092 |
| 9 | 0.010 | 0.18 | 1.49 | 10.9 | 0.49 | 0.51 | 0.009 | 740 | 820 | 950 | — | 700 | 213 | 0.089 |
| 10 | 0.010 | 0.03 | 1.81 | 12.1 | 0.23 | 0.26 | 0.011 | 740 | 850 | 1000 | — | 700 | 230 | 0.074 |
| 11 | 0.023 | 0.21 | 1.49 | 12.9 | 1.50 | 0.50 | 0.009 | 680 | 800 | 1000 | — | 650 | 180 | 0.045 |
| | | | | | | Comparative Examples | | | | | | | | |
| 12 | 0.036 | 0.20 | 1.52 | 12.0 | 0.29 | 0.28 | 0.010 | 730 | 840 | 1000 | — | 700 | 125 | 0.084 |
| 13 | 0.021 | 0.20 | 1.52 | 12.0 | — | 0.21 | 0.010 | 780 | 920 | 1000 | — | 700 | 132 | 0.084 |
| 14 | 0.230 | 0.20 | 1.49 | 11.9 | 0.31 | — | 0.013 | 730 | 840 | 1000 | — | 700 | 135 | 0.084 |
| 15 | 0.010 | 0.19 | 1.49 | 8.9 | 0.21 | 0.23 | 0.015 | 740 | 850 | 950 | — | 700 | 203 | 0.541 |
| 16 | 0.010 | 0.21 | 1.48 | 14.8 | 1.52 | 0.20 | 0.012 | 780 | 890 | 1000 | — | 709 | 85 | 0.041 |
| 17 | 0.010 | 0.71 | 1.51 | 12.1 | 0.23 | 0.31 | 0.009 | 720 | 830 | 1000 | — | 700 | 92 | 0.070 |
| 18 | 0.012 | 0.21 | 0.31 | 12.1 | 0.25 | 0.30 | 0.010 | 800 | 900 | 1000 | — | 600 | 86 | 0.068 |
| 19 | 0.010 | 0.22 | 1.50 | 12.5 | 0.21 | 1.50 | 0.011 | 730 | 820 | 1000 | — | 700 | 97 | 0.075 |
| 20 | 0.010 | 0.19 | 1.49 | 12.5 | 0.23 | 0.32 | 0.035 | 730 | 840 | 1000 | — | 700 | 112 | 0.079 |
| 21 | 0.011 | 0.18 | 1.47 | 11.9 | 1.03 | 0.49 | 0.011 | 700 | 810 | 950 | 760 | — | 56 | 0.069 |
| 22 | 0.011 | 0.18 | 1.47 | 11.9 | 1.03 | 0.49 | 0.011 | 700 | 810 | 950 | 760 | 650 | 98 | 0.064 |

(*1) Absorbed energy for heat-affected Zone
(*2) Corrosion rate by carbonic Acid Gas
**Underlines indicate values outside of the range of the invention.

EXAMPLE 2

Steels having compositions as shown in Tables 2-(1) (Examples of the Invention) and 2-(2) (Comparative Examples) were prepared and formed into slabs by continuous casting, and then hot rolled to form steel sheets 15 mm thick. Thereafter, the steel sheets were quenched by heating at 900° C. and air-cooling, followed by tempering at 680° C. (which was lower than the $Ac_1$ point).

After the sheets were welded together, an oblique Y-groove weld cracking test in accordance with JIS Z3158 was performed on these steel sheets at a preheating temperature of 30° C. to evaluate the resistance to weldability. Steel sheets which exhibited weld cracking are marked with an "Y" and those which exhibited no weld cracking are marked with "O" in Tables 3-(1) (Examples of the Invention) and 3-(2) (Comparative Examples). The welded joints were formed between the steel sheets through TIG welding (neither preheating nor postheating was effected). No cross-sectional cracking was observed.

A Charpy impact test was performed on the welding-heat-affected zones of the joints. A heat input of 15 kJ/cm was used, and the specimens were sampled from the heat-affected zones in accordance with JIS 4 (notch position: 1 mm apart from a bond), and absorbed energies were measured at 0° C.

Further, all of the steel sheets were exposed to carbonic acid gas to evaluate pitting resistance and general corrosion resistance. The test was performed by preparing steel specimens of 3.0 mm×25 mm×50 mm, dipping the specimens into an autoclave containing a 20% NaCl solution in which a carbonic acid gas of 3.0 MPa was saturated, and holding the test pieces therein at 80° C. for seven days.

Pitting resistance was evaluated by washing the exposed test pieces with water and then drying, followed by visual observation to determine whether pits were formed on the surfaces. Specimens exhibiting one or more pits were marked with an "x" while those with no pits were marked with an "O" in Tables 3-(1) and 3-(2).

General corrosion resistance was evaluated after washing the specimens with water followed by drying. Subsequently, the weight loss rates of the specimens were measured and compared with their original weights. The weight loss rates were reduced were converted into thickness reductions projected over a one year period, and the results of these tests are shown in Tables 3-(1) and 3-(2).

As seen in Table 3-(1), weld cracking was not observed in the Examples of the present invention even at the preheating temperature of 30° C., thus confirming the excellent weld cracking resistance of the invention. Further, since absorbed energies in heated-affected zones of Example 2 shows 180 J or more at 0° C., excellent toughness in the heat-affected zones was demonstrated. Further, the Examples of the Invention experienced no pitting and a corrosion rate of 0.1 mm/year or slower, which reveals the excellent pitting resistance and general corrosion resistance of the invention.

The Comparative Examples were not in accordance with the present invention and exhibited characteristics inferior to those Examples produced in accordance with the present invention. Specifically, the Comparative Examples exhibited weld cracking, low toughness in heat-affected zones, pitting and the like as shown in Table 3-(2).

TABLE 2

| No. | Chemical Composition (wt %) C | Si | Mn | Cr | Ni | Cu | N | Ti | V | Zr | Nb | Ta | total of Ti to Ta | Value x or y |
|---|---|---|---|---|---|---|---|---|---|---|---|---|---|---|
| | | | | | | Examples of the Invention | | | | | | | | |
| 1 | 0.011 | 0.20 | 1.51 | 12.0 | 1.03 | 0.51 | 0.010 | | | | | | — | 13.50 |
| 2 | 0.010 | 0.19 | 1.49 | 11.0 | 0.80 | 0.51 | 0.009 | | | | | | — | 12.50 |
| 3 | 0.010 | 0.21 | 1.49 | 12.1 | 1.02 | 0.49 | 0.009 | 0.020 | 0.059 | | | | 0.079 | 13.62 |
| 4 | 0.018 | 0.20 | 1.49 | 12.0 | 0.81 | 0.51 | 0.011 | | 0.042 | | | | 0.042 | 13.52 |
| 5 | 0.011 | 0.19 | 1.53 | 11.9 | 0.82 | 0.50 | 0.025 | 0.030 | | | 0.050 | | 0.080 | 13.45 |
| 6 | 0.010 | 0.18 | 1.50 | 10.9 | 0.79 | 0.49 | 0.012 | | 0.071 | 0.020 | | | 0.091 | 12.43 |
| 7 | 0.011 | 0.20 | 1.49 | 12.9 | 0.50 | 0.28 | 0.011 | 0.050 | 0.045 | | | | 0.095 | 13.80 |
| 8 | 0.009 | 0.18 | 1.52 | 11.2 | 0.27 | 0.49 | 0.012 | 0.030 | 0.049 | | | 0.030 | 0.109 | 12.75 |
| 9 | 0.018 | 0.21 | 1.52 | 11.0 | 0.80 | 0.40 | 0.011 | | 0.051 | | 0.040 | | 0.091 | 12.24 |
| 10 | 0.010 | 0.19 | 1.47 | 11.9 | 0.98 | 0.25 | 0.011 | 0.020 | 0.051 | | | | 0.071 | 12.69 |
| 11 | 0.011 | 0.21 | 1.52 | 11.8 | 0.80 | 0.39 | 0.012 | 0.105 | 0.042 | | | | 0.147 | 13.08 |
| 12 | 0.013 | 0.19 | 1.49 | 12.1 | 0.85 | 0.52 | 0.011 | | 0.045 | | 0.015 | 0.043 | 0.103 | 13.72 |
| 13 | 0.012 | 0.18 | 1.51 | 11.8 | 0.79 | 0.55 | 0.015 | 0.021 | 0.035 | 0.035 | 0.020 | | 0.111 | 13.53 |
| | | | | | | Comparative Examples | | | | | | | | |
| 14 | 0.025 | 0.21 | 1.49 | 11.8 | 0.99 | 0.58 | 0.016 | 0.015 | 0.042 | | | | 0.057 | 13.52 |
| 15 | 0.012 | 0.19 | 1.51 | 11.9 | 0.98 | 0.49 | 0.038 | | 0.049 | | | | 0.049 | 13.38 |
| 16 | 0.011 | 0.20 | 1.53 | 9.2 | 1.20 | 0.63 | 0.012 | | 0.054 | | | | 0.054 | 11.11 |
| 17 | 0.012 | 0.19 | 1.50 | 14.1 | 0.75 | 0.45 | 0.011 | 0.015 | 0.045 | | 0.025 | | 0.085 | 15.50 |
| 18 | 0.011 | 0.22 | 1.48 | 12.1 | 0.01 | 0.54 | 0.013 | 0.021 | 0.035 | | | | 0.056 | 13.74 |
| 19 | 0.012 | 0.19 | 1.51 | 11.9 | 1.01 | 1.52 | 0.011 | 0.015 | 0.045 | | | | 0.060 | 16.48 |
| 20 | 0.010 | 0.22 | 1.49 | 12.1 | 1.02 | 0.46 | 0.013 | 0.172 | 0.088 | | 0.085 | | 0.345 | 13.80 |
| 21 | 0.015 | 0.23 | 1.49 | 11.7 | 1.10 | 0.11 | 0.011 | 0.015 | 0.068 | | | | 0.083 | 12.07 |
| 22 | 0.019 | 0.19 | 1.50 | 11.1 | 0.89 | 0.30 | 0.012 | 0.023 | 0.051 | | | | 0.074 | 12.02 |

TABLE 3

| No. | Tensile properties of mother material YS (MPa) | TS (MPa) | $_vE_0$ (J) | Welding crack | $_vE_0$ in heat-affected zone (J) | Pit-ting | Corrsion rate (mm/Y) |
|---|---|---|---|---|---|---|---|
| | | | Example of the invention | | | | |
| 1 | 605 | 710 | 265 | o | 220 | o | 0.069 |
| 2 | 593 | 705 | 272 | o | 231 | o | 0.084 |
| 3 | 620 | 732 | 255 | o | 205 | o | 0.072 |
| 4 | 595 | 700 | 265 | o | 185 | o | 0.085 |
| 5 | 600 | 715 | 252 | o | 195 | o | 0.078 |
| 6 | 625 | 730 | 283 | o | 214 | o | 0.085 |
| 7 | 615 | 720 | 272 | o | 188 | o | 0.051 |
| 8 | 580 | 703 | 293 | o | 203 | o | 0.089 |
| 9 | 575 | 695 | 275 | o | 196 | o | 0.088 |
| 10 | 593 | 703 | 269 | o | 230 | o | 0.069 |
| 11 | 607 | 723 | 273 | o | 193 | o | 0.078 |
| 12 | 587 | 693 | 292 | o | 223 | o | 0.073 |
| 13 | 596 | 704 | 280 | o | 215 | o | 0.080 |
| | | | Comparative Example | | | | |
| 14 | 609 | 725 | 240 | x | 168 | o | 0.080 |
| 15 | 582 | 695 | 200 | x | 112 | o | 0.086 |
| 16 | 596 | 721 | 263 | o | 209 | x | 0.541 |
| 17 | 573 | 699 | 252 | o | 178 | o | 0.040 |
| 18 | 595 | 715 | 205 | o | 131 | o | 0.103 |
| 19 | 602 | 715 | 180 | o | 95 | o | 0.062 |
| 20 | 589 | 702 | 156 | x | 85 | o | 0.074 |
| 21 | 601 | 721 | 273 | o | 211 | x | 0.159 |
| 22 | 590 | 717 | 207 | o | 93 | x | 0.201 |

EXAMPLE 3

Molten steels having compositions as shown in Table 4 were prepared in a converter and formed into steel pipe materials by continuous casting. The steel pipe materials were formed into 273 mmϕ steel pipes by plug mill rolling. Thereafter, the steel pipes were heated to 900° C. and quenched with water, then heated to 680° C. (which was lower than the $Ac_1$ point) and held at that temperature, followed by air-cooling.

Specimens sampled from the steel pipes were subjected to testing to determine their mechanical properties and corrosion resistance. The corrosion resistance was tested under the same conditions as those of Example 2.

Welded joints of steel pipe were made by the TIG welding (voltage: 16 V, current: 180 A, welding speed: 6.0 cm/min.), and the Charpy test was performed on the heat-treated zones (1 mm away from bond).

The results of the tests are shown in Table 4. Since the steel pipes of Example 4 exhibit excellent pitting resistance, general corrosion resistance and toughness in the heat-affected zones, they have characteristics well-adapted for service in pipelines.

As described above, the present invention provides a high-Cr martensitic steel pipe which exhibits excellent pitting resistance and general corrosion resistance in an environment containing a carbonic acid gas and, in addition, exhibits excellent weldability and toughness in the heat-affected zones. Consequently, according to the present invention, line pipes for transporting petroleum and natural gas can be provided at a low cost, by which the present invention will greatly contribute to the growth of industries.

Although this invention has been described with reference to specific elements and method steps, equivalent elements and method steps may be substituted, the sequence of the steps may be varied, and certain elements and method steps may be used independently of others. Further, various other elements and control steps may be included, all without departing from the spirit and scope of the invention defined in the appended claims.

TABLE 4

| No. | Chemical Composition (wt %) C | Si | Mn | Cr | Ni | Cu | N | Ti | V | Zr | Nb | Ta | total of Ti to Ta | Value x or y |
|---|---|---|---|---|---|---|---|---|---|---|---|---|---|---|
| A | 0.010 | 0.21 | 1.51 | 10.9 | 0.81 | 0.49 | 0.009 | — | — | — | — | — | — | 12.34 |
| B | 0.011 | 0.20 | 1.52 | 11.1 | 1.51 | 0.51 | 0.011 | 0.035 | 0.031 | — | — | — | 0.066 | 12.66 |

| No. | Mother Material YS MPa | $_vE_0$ in affected zone (J) | Pitting | Corrosion rate (mm/Y) | Reference |
|---|---|---|---|---|---|
| A | 589 | 210 | o | 0.072 | Example of the invention |
| B | 605 | 223 | o | 0.067 | Example of the invention |

What is claimed is:

1. A high-Cr martensitic steel pipe having excellent pitting resistance, general corrosion resistance, excellent weldability and heat-affected zone toughness, and further having absorbed energy for heat-affected zone at 0° C. of more than 170 J, and corrosion rate of mother material including welded portions, under the condition of immersing in a corrosion-test liquid of 20% NaCl solution in which a carbonic acid gas of 3.0 MPa was saturated at 80° C., of lower than 0.1 mm/Year, consisting essentially of:

C: about 0.03 wt % or less, Si: about 0.5 wt % or less, Mn: about 0.5–3.0 wt %, Cr: about 10.0–14.0 wt %, Ni: about 0.2–2.0 wt %, Cu: about 0.2–0.7 wt %, N: about 0.03 wt % or less, V: about 0.01–0.1 wt % and the balance being Fe and incidental impurities, wherein a value X defined by the following formula (1):

$$\text{value } X=(\text{Cr }\%)+3(\text{Cu }\%)-3(\text{C }\%) \quad (1)$$

is about 12.2 to about 14.2.

2. A high-Cr martensitic steel pipe for line pipes having absorbed energy for heat-affected zone at 0° C. of more than 170 J, and corrosion rate of mother material including welded portions, under the condition of immersing in a corrosion-test liquid of 20% NaCl solution in which a carbonic acid gas of 3.0 MPa was saturated at 80° C., of lower than 0.1 mm/Year, manufactured from a steel consisting essentially of:

C: about 0.03 wt % or less, Si: about 0.5 wt % or less, Mn: about 0.5 to 3.0 wt %, Cr: about 10.0 to 14.0 wt %, Ni: about 0.2 to 2.0 wt %, Cu: about 0.2 to 0.7 wt %, N: about 0.03 wt % or less, V: about 0.01–0.1 wt % and the balance being Fe and incidental impurities, and having an X value of about 12.2 or more, wherein said X value is represented by the following equation (1):

$$X \text{ value}=(\text{Cr }\%)+3(\text{Cu }\%)-3(\text{C }\%) \quad (1),$$

said steel being subjected to formation of a pipe with a pipe-making machine, austenitizing treatment, quenching and tempering.

3. A high-Cr martensitic steel pipe for line pipes having absorbed energy for heat-affected zone at 0° C. of more than 170 J, and corrosion rate of mother material including welded portions, under the condition of immersing in a corrosion-test liquid of 20% NaCl solution in which a carbonic acid gas of 3.0 MPa was saturated at 80° C., of lower than 0.1 mm/Year, manufactured from a steel consisting essentially of:

C: about 0.03 wt % or less, Si: about 0.5 wt % or less, Mn: about 0.5 to 3.0 wt %, Cr: about 10.0 to 14.0 wt %, Ni: about 0.2 to 2.0 wt %, Cu: about 0.2 to 0.7 wt %, N: about 0.03 wt % or less, V: about 0.01–0.1 wt % and the balance being Fe and incidental impurities, and having an X value of about 12.2 or more, said X value being represented by the following equation (1):

$$X \text{ value}=(\text{Cr }\%)+3(\text{Cu }\%)-3(\text{C }\%) \quad (1),$$

said steel being subjected to formation of a pipe with a pipe-making machine, austenitizing treatment, quenching and heat treatment in a dual-phase region.

4. A high-Cr martensitic steel pipe for line pipes having absorbed energy for heat-affected zone at 0° C. of more than 170 J, and corrosion rate of mother material including welded portions, under the condition of immersing in a corrosion-test liquid of 20% NaCl solution in which a carbonic acid gas of 3.0 MPa was saturated at 80° C., of lower than 0.1 mm/Year, manufactured from a steel consisting essentially of:

C: about 0.03 wt % or less, Si: about 0.5 wt % or less, Mn: about 0.5 to 3.0 wt %, Cr: about 10.0 to 14.0 wt %, Ni: about 0.2 to 2.0 wt %, Cu: about 0.2 to 0.7 wt %, N: about 0.03 wt % or less, V: about 0.01–0.1 wt % and the balance being Fe and incidental impurities, and having an X value of about 12.2 or more, said X value being represented by the following equation (1):

$$X \text{ value}=(\text{Cr }\%)+3(\text{Cu }\%)-3(\text{C }\%) \quad (1),$$

said steel being subjected to formation of a pipe with a pipe-making machine, austenitizing treatment, quenching, heat treatment in a dual-phase region, and tempering.

* * * * *

UNITED STATES PATENT AND TRADEMARK OFFICE

CERTIFICATE OF CORRECTION

PATENT NO. : 5,858,128

DATED : January 12, 1999

INVENTOR(S) : Miyata, et al

It is certified that error appears in the above-identified patent and that said Letters Patent is hereby corrected as shown below:

In Column 7, at line 41, please change " "Y" " to --"X"--; and in Column 8, at Table 1-continued, at the subheading "T", at example 16, please change "709" to --700--.

Signed and Sealed this

Twentieth Day of July, 1999

*Attest:*

*Attesting Officer*

Q. TODD DICKINSON

*Acting Commissioner of Patents and Trademarks*